US007854694B1

(12) United States Patent
Frunzi

(10) Patent No.: US 7,854,694 B1
(45) Date of Patent: Dec. 21, 2010

(54) EXERCISE VEST

(76) Inventor: Gary Frunzi, P.O. Box 1086, South Fallsburg, NY (US) 12779

( * ) Notice: Subject to any disclaimer, the term of this patent is extended or adjusted under 35 U.S.C. 154(b) by 0 days.

(21) Appl. No.: 12/231,394

(22) Filed: Sep. 2, 2008

(51) Int. Cl.
*A63B 21/02* (2006.01)

(52) U.S. Cl. ..... 482/124; 482/121

(58) Field of Classification Search ..... 482/121, 482/124–125, 127, 74; 2/44, 310, 326–327, 2/462

See application file for complete search history.

(56) References Cited

U.S. PATENT DOCUMENTS

| | | | | | |
|---|---|---|---|---|---|
| 650,656 | A | | 5/1900 | Raabe | |
| 1,402,179 | A | | 1/1922 | Piscitelli | |
| 4,247,996 | A | * | 2/1981 | Grapin et al. | 36/103 |
| 5,358,461 | A | * | 10/1994 | Bailey, Jr. | 482/2 |
| 5,618,249 | A | * | 4/1997 | Marshall | 482/127 |
| 5,792,034 | A | * | 8/1998 | Kozlovsky | 482/124 |
| 5,916,070 | A | * | 6/1999 | Donohue | 482/74 |
| 6,287,242 | B1 | * | 9/2001 | Fray | 482/121 |
| 6,546,561 | B2 | * | 4/2003 | Duhamell | 2/102 |
| 6,659,921 | B2 | * | 12/2003 | Vernon | 482/124 |
| 6,691,318 | B1 | * | 2/2004 | Davis | 2/102 |
| 2003/0125170 | A1 | * | 7/2003 | Vernon | 482/124 |
| 2005/0282689 | A1 | | 12/2005 | Weinstein | |
| 2007/0219074 | A1 | * | 9/2007 | Pride | 482/124 |

* cited by examiner

*Primary Examiner*—Fenn C Mathew
(74) *Attorney, Agent, or Firm*—Sandra M. Kotin

(57) ABSTRACT

An exercise vest for upper body development is disclosed. The vest has a series of horizontal straps, adjustable in length, that encircle the vest and fasten in front to secure the vest on the person and provide upper body support. There are three elastic band assemblies to provide a complete range of upper body movements which involve all upper body muscle groups. Body development is achieved using the resistance of the elastic bands. A rear band is grasped by a handlebar and raised straight over the head. When not in use the handlebar is fixedly held above the shoulders by means of clips attached on each side of the vest. There are upper and lower side elastic band pairs which have hand grips for each hand. These elastic bands can be stretched up and down and forward and back as desired for a complete workout. The elastic bands are linearly adjustable by means of specially designed canisters containing winding spools that enable the lengths of the elastic bands to be altered in discrete increments. Each alteration of the length of an elastic band alters its resistance. The canisters also serve as the means to affix the bands to the vest.

30 Claims, 3 Drawing Sheets

EXERCISE VEST

FIELD OF THE INVENTION

The instant invention relates to a vest equipped with a series of stretchable bands with which to perform upper body exercises and the method of use of same.

BACKGROUND OF THE INVENTION

Various forms of exercise and exercise apparatus have been known from the time of the ancient civilizations. In recent years exercise has become a lucrative as well as beneficial endeavor. Though there is a great proliferation of gyms and studios dedicated to a wide variety of exercises, many people still prefer to exercise at home at their own convenience and on their own schedule. As a result, there have been a number of exercise devices and aids to assist in enabling an individual to maintain his or her own regimen. Since some exercise equipment can be quite expensive as well as requiring considerable space in the home, exercise enthusiasts have endeavored to construct devices to work various parts of the body using simple means that require minimal storage space. This is especially true of an exercise apparatus to work the muscles of the upper torso.

In U.S. Pat. No. 1,402,179, Piscitelli describes a shoulder harness having a rigid back member with a guide through which a series of elastic bands are slidably passed. The bands extend forward on each side and terminate with hand grips. The user can have one grip in each hand and stretch the bands evenly with both arms extended or with one arm close to the body and the other arm extended. A waist band helps to keep the harness in place. This exercise harness provides limited range of movement and the bands can rub against the back of the arms which can make any benefit problematic.

Raabe, in U.S. Pat. No. 650,656, teaches the use of long straps that are attached to a waist band at the back, extend over the shoulders and are attached to the waist band in the front. There is a cross strap at the upper back with pads inside where the cross strap attaches to the long straps. Upper rings are attached over the pads and lower rings at the waist in back. Elastic bands with hand grips are affixed to the upper rings and the user can stretch his or her arms forward or to the side against the resistance of the elastic. Elastic bands with foot straps are attached to the lower rings. The user can use both sets of elastic bands when walking or running. The elastic bands can rub against the backs of the arms and against the legs to limit the range of movement.

A similar set of straps is taught by Vernon in U.S. Pat. No. 6,659,921. This exercise device has a rigid shoulder piece or yoke, a waist band, and adjustable vertical straps. There are upper attachment points at each side of the shoulder piece and lower attachment points on each side of the waist band for the attachment of one end of each of a series of elastic bands. There are hand grips on the other ends of the elastic bands. The user selects the upper or lower points and each provides resistance exercises for different muscles groups. An alternative embodiment uses crossed elastic bands threaded through tubes so that the user can select the upper or lower sets or use one upper and the opposite lower to pull the same elastic band from both ends. Panels attached at the shoulder and waist can provide compartments for other possessions or to hold a water bottle. Weinstein discloses another strap arrangement, with the straps crossed in back and attached to a waistband. There are attachment points in the front on the upper part of the straps for short elastics with hand grips and on the waist band for long elastics with foot straps. There are also elastic bands attached at the back of the waist band to be stretched over the shoulders and pulled forward. This device provides no body support and attaching the leg bands in front could cause tripping. (U.S. Patent Application Publication No. 2005/0282689)

In U.S. Pat. No. 5,792,034, Kozlovsky describes a vest-like flexible shell made up of an upper shoulder section and lower torso section that adheres closely to the body. Adjustable vertical straps in front and a wide waist band keep the shell in place. There is a housing at the center back through which elastic bands are passed. The upper bands are a set of three that pass through the housing and extend over each shoulder terminating with a hand grip. The bands also pass over rollers and through guides for smooth movement and minimal abrasion. The upper bands move freely through the housing and can be extended at the same distance by having both hands pull at the same time or at longer distances by having one hand pulling at a time. There are two distinct sets of lower bands which both extend from the housing, over rollers, through the guides, downward terminating with foot straps. All of the lower elastic bands have end stops which are retained within slots in the housing. Each set of bands is comprised of three strands of different resistances. Each band may be used with one, two or three strands at a time allowing for five different resistances. A second embodiment permits the vest to be extended or contracted in length according to the height of the user. The vest is removed to change the resistance. The user must remove the cover from the housing and remove or reinsert one or more of the strands. The upper bands can only be used by passing them over the shoulders so the range of movements is considerably limited.

An exercise vest is taught by Davis in U.S. Pat. No. 6,691,318. This vest is closed by two clasps at the front. There is one ring attached at the top of each shoulder and one ring on each side at waist level. Elastic bands extend through the shoulder ring and through the side ring along each side of the vest. Hand grips prevent the bands from sliding back through the rings. The bands are guided by sewn channels along each side of the back of the vest. If the user selects to use the upper grips, the bands are pulled until the hand grips at the lower ends are stopped by the waist rings and vice versa. Other than the use from the shoulder or the waist, the bands are not adjustable and the resistance is always the same. The fabric guides at the back of the vest are curved and will pucker when the bands are pulled tight during use causing stress on the fabric.

There is a need for an exercise vest that enables the user to perform upper body exercises over a wide range of movements. There is a need for an exercise vest that is flexible yet supports the upper body during exercise and can be adjusted to the size of the user. There is a need for an exercise vest in which the resistance can be altered according to preference without having to add or remove any parts. There is a need for an exercise vest that enables the user to exercise one arm at a time if desired and which can be used when standing or seated.

BRIEF SUMMARY OF THE INVENTION

The present invention provides an exercise vest that is flexible and adjustable yet provides considerable upper body support. The vest has three band assemblies emanating from three different locations for maximum variations in arm movements and to fully condition all upper body muscle groups. The resistance of the elastic bands can be adjusted without having to add or remove parts. The wide variety of arm movements is made possible by the location, angle and grips provided to the elastic bands.

It is an object of the present invention to provide an exercise vest that is light weight, portable and requires minimal storage space.

It is another object of the present invention to provide an exercise vest that has three individual elastic band assemblies for maximum work-out possibilities.

A further object of the present invention is to provide an exercise vest having fully adjustable support straps for a proper fit on a range of user sizes and for maximum upper body support during use.

A still further object of the present invention is to provide an exercise vest wherein each of the elastic band assemblies can be adjusted to the desired resistance from within the vest and without having to add or remove parts.

A further object of the present invention is to provide adjustment means that are simple to use and enable a smooth range of desired band resistances.

It is an object of the present invention to provide adjustment means that permit subtle as well as substantial changes to the band resistance.

Another object of the present invention is to provide an exercise vest that can be utilized by persons that are standing or seated and by persons with disabilities such as persons in wheelchairs.

It is also an object of the present invention to provide an exercise vest that is easy and inexpensive to manufacture and which will last through extensive use.

The invention is an exercise device which comprises a vest having a back panel, and two front panels. There are at least two horizontal straps that encircle the vest, are attached to it, and are closable in the front of the vest and includes means to close the straps in front of the vest. A rear elastic band has a first end and a second end, the first end being affixed to the inside of the back panel and the second end passing though an opening in the back panel above the point of fixation of the first end and being affixed to a handle. At least one upper side elastic band has a first end and a second end, the first end being affixed to the inside of the back panel below the point of fixation of the rear elastic band and the second end passing through an opening in one of the front panels and being affixed to a hand grip, and at least one lower side elastic band has a first end and a second end, the first end being affixed to the inside of the back panel below the point of fixation of the at least one upper side elastic band and the second end passing through an opening in one of the front panels situated below the opening for the at least one upper side elastic band and being affixed to a hand grip. Included are the means to affix the elastic bands to the inside of the back panel. A user can select at least one of the elastic bands, grasp the handle or hand grip and perform exercises by stretching the at least one elastic band according to his or her abilities.

The invention is also an exercise device which comprises a vest having a back panel, a right front panel and a left front panel. The vest has at least three horizontal straps that encircle the vest, are attached to it, and are closable in the front of the vest with means to close the straps in front of the vest. There is a rear band having a first end and a second end, the first end being affixed to the inside of the back panel and the second end passing though an exit opening in the back panel above the point of fixation of the first end and being affixed to a handle. Also present are two upper side bands each having a first end and a second end, the first ends being affixed to the inside of the back panel below the point of fixation of the rear band, the second end of one band passing through an exit opening in the right front panel, the second end of the other band passing through an exit opening in the left front panel and the second ends of both bands being affixed to hand grips and two lower side bands each having a first end and a second end, the first ends being affixed to the inside of the back panel below the points of fixation of the upper side bands, the second end of one band passing through an exit opening in the right front panel, the second end of the other band passing through an exit opening in the left front panel, both exit openings being below the exit openings for the upper side bands and the second ends of both bands being affixed to hand grips. There are also means to impart stretchability to the bands and means to affix the bands to the inside of the back panel. A user can select at least one of the bands, grasp the handle or hand grip and perform exercises by stretching the band according to his or her abilities.

The invention can also be described as an exercise device which comprises a vest having a back panel, a right front panel and a left front panel with four horizontal straps that encircle the vest, are attached thereto, are closable in the front of the vest, and means to close the straps in front of the vest. There is a rear elastic band having a first end and a second end, the first end being affixed to the inside of the back panel and the second end passing though an exit opening in the back panel above the point of fixation of the first end and being affixed to a handle, two upper side elastic bands each having a first end and a second end, the first ends being affixed to the inside of the back panel below the point of fixation of the rear elastic band, the second end of one elastic band passing through an exit opening in the right front panel, the second end of the other elastic band passing through an exit opening in the left front panel and the second ends of both elastic bands being affixed to hand grips, two lower side elastic bands each having a first end and a second end, the first ends being affixed to the inside of the back panel below the points of fixation of the upper side elastic bands, the second end of one elastic band passing through an exit opening in the right front panel, the second end of the other elastic band passing through an exit opening in the left front panel, both exit openings being below the exit openings for the upper side elastic bands and the second ends of both elastic bands being affixed to hand grips, and means to affix the elastic bands to the inside of the back panel. A user can select at least one of the elastic bands, grasp the handle or hand grip and perform exercises by stretching the at least one elastic band according to his or her abilities.

A method of exercising the upper body is disclosed and comprises the steps of first obtaining an exercise vest which comprises a back panel, a right front panel and a left front panel, four horizontal straps that encircle the vest, are attached thereto, and are closable in the front of the vest, means to close the straps in front of the vest, a rear elastic band having a first end and a second end, the first end being affixed to the inside of the back panel and the second end passing though an exit opening in the back panel above the point of fixation of the first end and being affixed to a handlebar, reversible holding means to securely hold the handlebar when not in use, two upper side elastic bands each having a first end and a second end, the first ends being affixed to the inside of the back panel below the point of fixation of the rear elastic band, the second end of one elastic band passing through an exit opening in the right front panel, the second end of the other elastic band passing through an exit opening in the left front panel and the second ends of both elastic bands being affixed to hand grips, two lower side elastic bands each having a first end and a second end, the first ends being affixed to the inside of the back panel below the point of fixation of the upper side elastic bands, the second end of one elastic band passing through an exit opening in the right front panel, the second end of the other elastic band passing through an exit opening in the left front panel, both exit openings being below the exit openings for the upper side elastic bands and the second ends of both elastic bands being affixed to hand grips and means to affix the elastic bands to the back panel and to alter the resistance of the elastic bands. Further steps include donning the exercise vest, securing the straps in the front of the exercise vest, selecting the rear elastic band, grasping the handlebar and releasing it from the reversible holding means, and holding the handlebar with both hands and raising the handlebar above the head and lowering the handlebar to shoulder level. The raising and lowering of the handlebar are repeated until a desired number of repetitions have been accomplished and the handlebar is returned to the reversible holding means. The next steps include selecting one of the pairs of side elastic bands, grasping the hand grip on the end of each elastic band and stretching the elastic bands by pulling on the hand grips in any desired direction and permitting the elastic bands to contract, repeating these movements until the desired number of repetitions have be accomplished, selecting the remaining pair of side elastic bands, grasping the hand grip on the end of each elastic band and stretching the elastic bands by pulling on the hand grips in any desired direction and permitting the elastic bands to contract, deciding that there is not the desired resistance in the remaining pair of side elastic bands, and removing the vest and altering the resistance of the side elastic bands. The remaining steps are donning the vest, securing the straps in the front of the exercise vest, grasping the hand grip on the end of each of the altered elastic bands and stretching the elastic bands by pulling on the hand grips in any desired direction and permitting the elastic bands to contract, repeating these movements until the desired number of repetitions have be accomplished, and removing the exercise vest. Upon completion of all steps, the upper body has been fully exercised.

The invention further provides an exercise device that comprises a vest assembly having a back panel, two front panels, and at least two horizontal straps that encircle the body and are closable in the front of the vest assembly, means for closing the straps in front of the vest assembly, rear tension means for creating resistance when stretched, a first portion of which is affixed to the back panel and a second portion of which is affixed to a handlebar, the handlebar being adapted to be grasped in both hands and raised and lowered vertically over the head of the user, at least two side tension means for creating resistance when stretched, a first portion of which is affixed to the vest assembly and a second portion of which is affixed to a hand grip, the hand grip being adapted to be extended from the side of the body forward, to the side, downward and upward, means for affixing the rear tension means, and means for affixing each of the at least two side tension means to the vest assembly, all of these means enabling the rear tension means and the at least two side tension means to be adjusted according to the abilities of the user. The user can select at least one of the tension means, grasp the handlebar or hand grip and perform exercises by stretching the at least one tension means according to his or her abilities.

Other features and advantages of the invention will be seen from the following description and drawings.

DETAILED DESCRIPTION OF THE INVENTION

Figure 2:
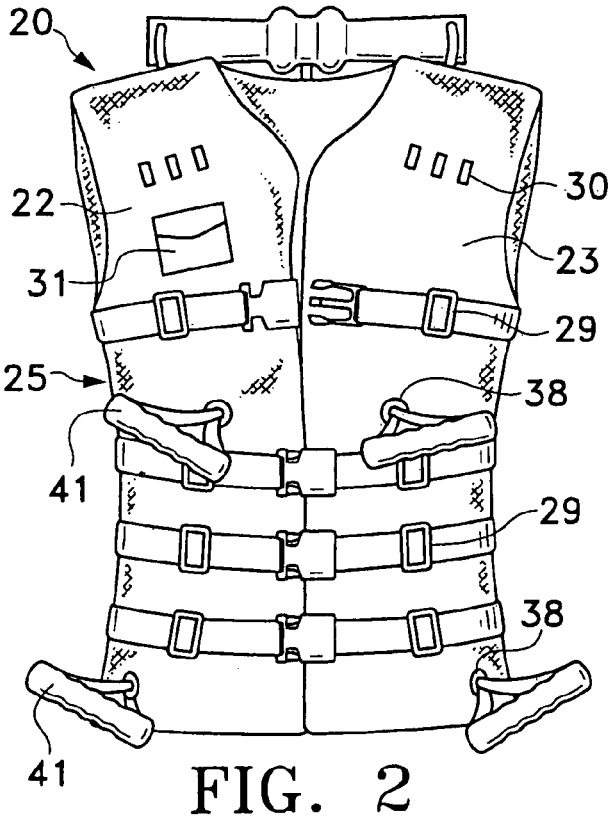
FIG. 2 is front elevational view of the vest when closed.
Figure 3:
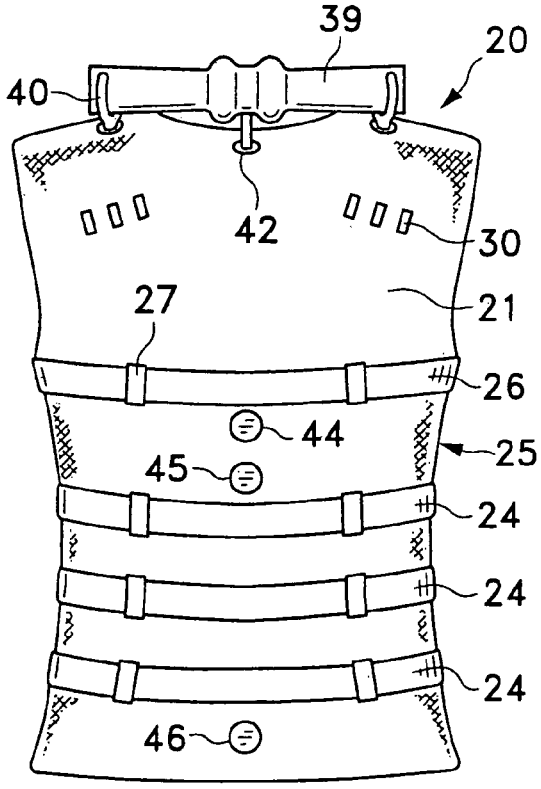
FIG. 3 is a rear elevational view of the vest when closed.

The exercise vest 20 of the present invention may contain a full back panel 21 and two full front panels, a right panel 22 and a left panel 23 seen in FIGS. 2 and 3. When worn, the upper torso may be fully enclosed in the vest 20 as may be seen in FIGS. 4, 5, and 6. There may be four straps that encircle the vest 20 to hold the vest 20 close to the body to insure the utmost control and performance. There may be three straps 24 below the mid-level 25 of the vest 20 and one strap 26 above the mid-level 25 as seen in FIGS. 2 and 3. The straps 24 and 26 may be attached directly to the back panel 21 or they may be fitted through loops 27 disposed at intervals around the vest 20. The straps 24 and 26 may be adjustable by slidable end pieces 29 or any other means known in the art and may be secured in the front of the vest 20 by clasps 28, buckles, hooks, snaps, ties, hook and loop fasteners, or other fasteners known in the art. One part of the fastener may be attached to each end of the strap so that the user can connect the ends in front. The length of the straps may also be adjusted from the front of the vest 20 using the slidable end pieces 29, for the comfort of the user and to achieve maximum upper body support. There may be air vents 30 at various locations about the vest 20 as well as a pocket 31 for the convenience of the user.

The training elements incorporated into the vest 20 may be a series of elastic bands that may be stretched individually or in pairs. Though this discussion may describe and illustrate bands that are elastic, the bands themselves may be non-elastic and may have stretchable and adjustable means near their points of attachment. Such bands are known in the art and may provide a similar workout when incorporated into this vest.

There may be one rear band 34, two upper side bands 35 and two lower side bands 36. The bands may be attached in vertical array along the inside center line of the back panel 21. Each band may pass through a guide tube 37 or binding, seen in FIG. 1, disposed along the inside of the back panel 21 of the vest 20. The guide tube for the rear band 34 may extend upward to an opening 42 in the back panel 21. The guide tubes for the upper side bands 35 and lower side bands 36 may extend to openings 43 in the left and right front panels 22 and 23. Each opening 42 and 43 may be surrounded by a grommet 38 to protect the opening and prevent the fabric from fraying. The bands may pass through the openings 42 and 43 and may be attached to handles which may be disposed on the outside of the vest 20. The handle at the end of the rear band 34 may be in the form of a handlebar 39 to which the band 34 may be affixed at its center. The handlebar 39 may rest at the top of the rear panel 21 at the back of the neck, and be held in place when not in use by means of two easily releasable support clips 40, one over each shoulder. The clips 40 may hold the handlebar 39 securely when it is not in use so that it does not interfere with the user's movements and does not rub against the neck of the user.

The handles at the ends of the other bands 35 and 36 may be in the form of hand grips 41. The upper side bands 35 may exit the vest 20 just below the midlevel 25 through openings 43 in each front panel 22 and 23. The lower side bands 36 may exit the vest 20 at about hip level, just below the lowermost strap 24, through openings 43 in each front panel 22 and 23. The elastic nature of the bands may insure that the hand grips lie close to the openings and will not flop about or hinder the user. The specific location of the side bands and hand grips may also be conveniently situated for easy grasping when being utilized.

The elastic bands may be attached to the vest by means of small canisters. There may be one canister for the rear band 34 (rear band canister 44); one canister for the two upper side bands 35 (upper side band canister 45); and one canister for the two lower side bands 36 (lower side band canister 46). The canisters may not only function to anchor the bands to the back panel 21 of the vest, but may be essential to the adjustment of the resistance of the bands as determined by the abilities of the user. The three canisters may be essentially the same in structure except that the rear band canister 44 may accommodate only the single rear band 34 while the other two canisters 45 and 46 may each accommodate two bands.

The rear band 34 may have a first end 33 which may be attached to the rear band canister 44 and a second end 32 which may be attached to the handlebar 39. The upper side bands 35 may each have a first end 47*a* for attachment to the upper band canister 45 and a second end 47*b* which may be attached to a hand grip 41. And, the lower side bands 36 may each have a first end 48 for attachment to the lower band canister 46 and a second end 49 which may also be attached to a hand grip 41.

Figure 7:
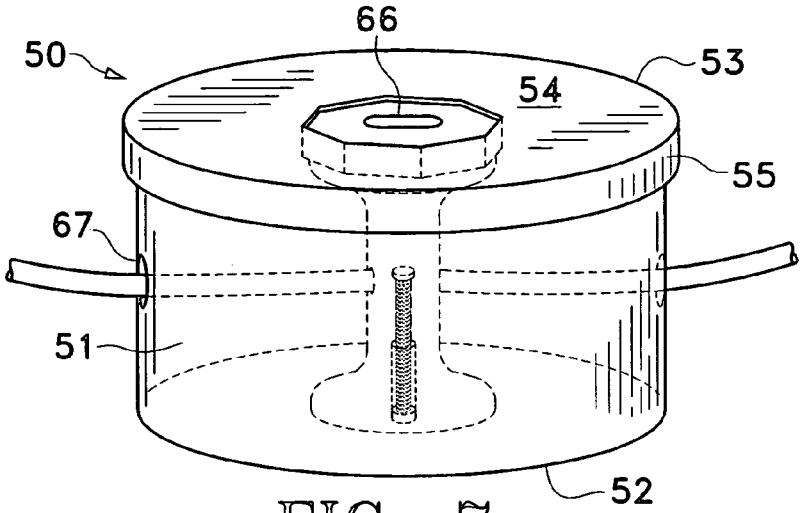
FIG. 7 is front perspective view of the band canister.
Figure 8:
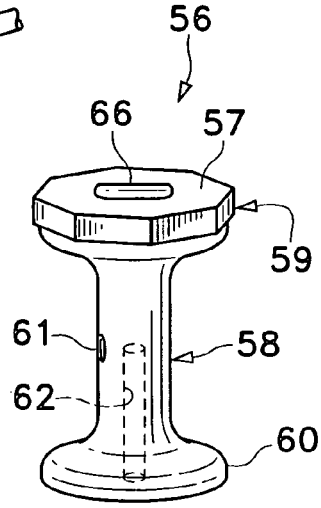
FIG. 8 is a front perspective view of the spool of the band canister.
Figure 9:
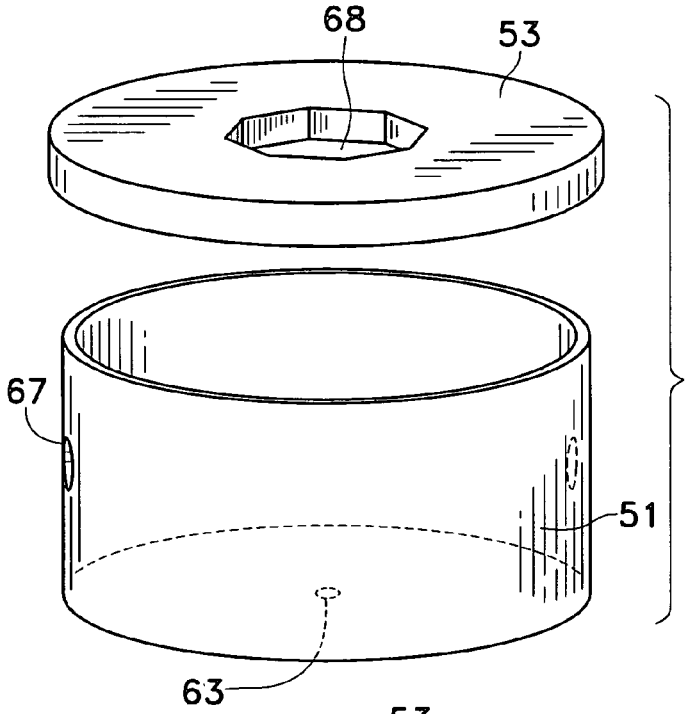
FIG. 9 is an exploded view of the canister and cover.

The basic canister 50 may be seen in FIG. 7. There may be a cylindrical housing 51 having a flat bottom 52 and a removable cover 53 that may also be flat on its upper surface 54. The cover 53 may have an annular downwardly facing rim 55 about its circumference. The rim 55 may fit closely over the upper edge of the housing 51 to essentially seal the housing 51 closed. There may be a spool 56 centrally disposed within the housing 51 and resting on the bottom 52 of the housing 51. The head 59 of the spool 56 may be in the form of a flat sided geometric figure such as an octagon. See FIGS. 7 and 8. There may be a similarly shaped (octagonal) cutout 68 in the center of the cover 53 which may be seen in FIG. 9. The spool 56 may be of a height such that the upper surface 57 of the head 59 of the spool 56 may be even with the upper surface 54 of the cover 53 so that the head 59 may fit closely within this cutout 68.

Figure 11:
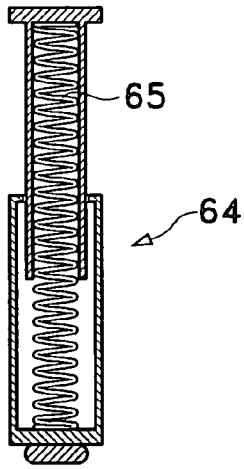
FIG. 11 is a vertical sectional view of the tension spring assembly of the canister.

The spool 56 may have a cylindrical central portion 58 with both the octagonal head 59 and a circular base 60 being larger in circumference. There may be a central vertical bore 62 through the lower half of the central portion 58. Disposed within the vertical bore 62 may be a tension spring 65 or a tension spring assembly 64. The tension spring assembly 64 may be in the form of a hollow piston and a cylinder within which a tension spring 65 may be disposed. If there is just a tension spring 65, it may be attached at its upper end to the top of the bore 62 and its lower end may be anchored through a small opening 63 to the bottom 52 of the housing 51. When a tension spring assembly 64 is used (seen in FIG. 11), the lower cylinder portion and spring 65 may be anchored to the bottom 52 of the housing 51 through the opening 63 and the piston portion may be affixed within the bore 62. The spool 56 is essential to the operation of the canister 50 and it must be rotatable. The tension spring attachments may be made in such a manner that the spool remains rotatable. A small flip up tab 66 may be located in a depression in the upper surface 57 of the head 59 of the spool 56 to facilitate lifting the spool until the octagonal head 59 is clear of the cutout 68 and may be grasped and rotated. The elastic bands may be attached to the central portion 58 of the spool 56 (at its midpoint 61) and may be wound or unwound onto or from the spool 56 when the spool 56 is rotated. The tension spring 65 may also bias the spool 56 by keeping it in place so it is not easily dislodged and by returning it to its usual position when released after being rotated. The spool 56 may remain in place against the bottom 52 of the housing 50 by the tension spring 65 until lifted by the user.

In the upper band canister 45 and lower band canister 46 there may be two opposing openings 67 in the sides of the housing 51 at the level of the midpoint 61 of the spool 56. The openings 67 may be seen in FIGS. 7 and 9. The rear band canister 44 may have only one opening. The elastic bands may extend outward of the canisters through these openings. The first ends of the elastic bands (33, 47*a*, 48) may be permanently attached to the spool by any means known in the art.

Since each user of the vest 20 may have different abilities or expectations, the bands may be made adjustable by means of the canisters 50. The operation of the canisters may be as follows: the first ends of two elastic bands (one for the rear band canister) may be attached to the midpoint 61 of the spool 56; the second end of one elastic band may be threaded through one side opening 67 in the housing 51, and the other through the opposing side opening 67; the second ends of the elastic bands may thereafter pass through the guides 37, the openings 43 in the front panels 22 and 23 and be attached to the hand grips 41 which also prevent the bands from being drawn back through the openings 43. To shorten or lengthen the bands and increase or decrease the resistance, the tab 66 on the top of the spool 56 may be flipped up and act as a handle to lift the spool 56 and pull it upward. The tension spring 65 may permit limited upward movement without the spool 65 being pulled completely out of the housing 51. The spool 56 may be lifted upward until the octagonal head 59 is clear of the octagonal cutout 68. The head 59 may then be grasped and rotated to wind or unwind the elastic bands onto or away from the spool 56. When the desired length of the elastic bands has been achieved the head 59 may be released and may be automatically pulled back downward by the tension spring 65 until the head 59 is within the octagonal cutout 68 and the spool 56 rests against the bottom 52 of the housing 51. The spool 56 may be locked into place through the tension in the spring 65, and prevented from further rotation due to the flat sides of the geometric configuration (octagonal) of the head 59 and the cutout 68. The flip tab 66 may be pressed down into the depression and may be even with the top surface 57 of the head 59 of the spool 56.

The choice of a many sided geometric figure such as an octagon for the shape of the head 59 of the spool 56 and the cutout 68 may permit subtle changes in the lengths of the elastic bands. The more surfaces to the geometric shape, the smaller may be the increment of rotation and therewith the increment of the length of band wound or unwound onto or away from the spool 56. It must be pointed out that the shape of the head of the spool and cutout may be triangular, square or any other angular shape. The angular shape may prevent the spool from rotating unless it is lifted and manually rotated. The increments of adjustment of the elastic bands may be dependent upon the number of sides chosen for the geometric configuration. The more sides, the smaller is each increment of adjustment.

Figure 1:
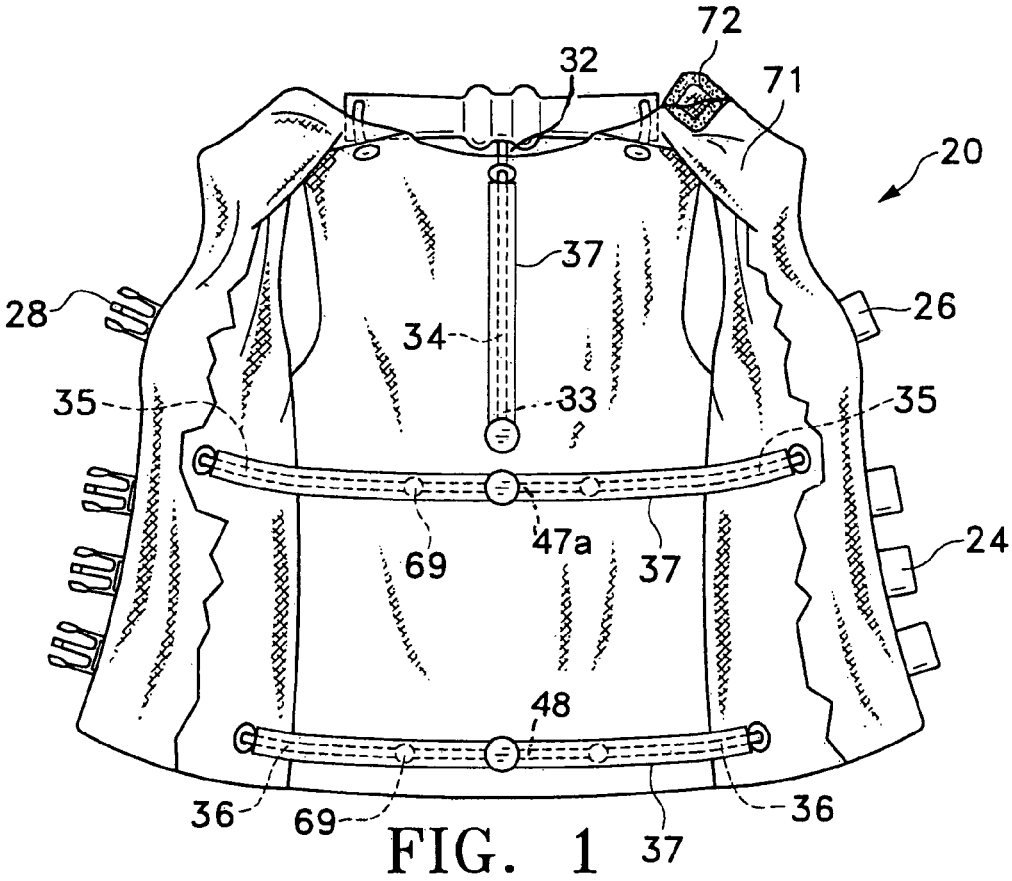
FIG. 1 is a front elevational view of the inside of the vest of the present invention.

To prevent the elastic bands from being over wound onto the spool 56, there may be stop beads 69, seen in FIG. 1, on the bands at a specific distance from the housing. The stop beads 69 may not fit through the side openings 67 of the housing 51. When the elastic bands are being shortened, once the stop beads 69 reach the openings 67 in the housing 51, the stop beads 69 may prevent the bands from being wound any further on to the spool 56. The stop beads 69 may limit the amount of tension possible in each elastic band and by doing so may also preserve the elastic bands since they cannot be wound to a point where they might break and cause injury to the user or be stretched to the point of fatigue. Should an elastic band become detached from a spool, the stop beads 69 may also prevent that elastic band from completely passing through its exit opening 42 or 43 in the vest since the stop beads 69 may be large enough so they may not pass through these openings.

Figure 10:
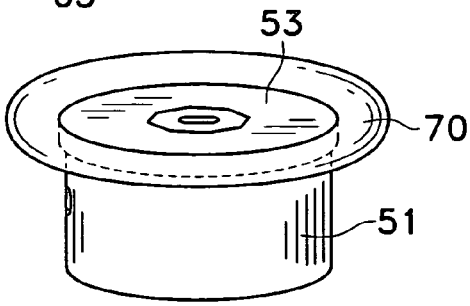
FIG. 10 is a perspective view of the canister with the attaching flange.

For easy access to the canisters they may be fastened into openings in the fabric of the back panel 21 of the vest 20. This may be accomplished in several ways. One way may be to have an attachment flange 70 extending outward from the circumference of the cover 53 and coplanar with the top surface 54 of the cover 53. This flange 70, seen in FIG. 10, may be stitched or crimped to the edges of an opening in the fabric of the back panel 21, or attached to the opening by any other means known in the art. A grommet may also be used for this purpose. The covers 53 of the canisters 50 and heads 59 of the spools 56 may be exposed along the outside of the back panel 21 of the vest 20 for easy access when the resistance of the bands is to be changed. See FIGS. 3 and 5. The housing 51 may lie inside the vest 20 so the elastic bands can extend from the canisters 50, through the guide tubes 37 along the inside of the back panel 21 and right and left front panels 22 and 23, and out of the vest through the openings 42 and 43 where they are attached to the handlebar 39 and hand grips 41.

To make the vest more comfortable and to conceal the guide tubes 37 and canisters 50 from the inside of the vest 20, there may be a lining 71 that covers the entire inside. The lining 71 may be sewn in place, or it may be attached by means of hook and loop fasteners 72 or any other suitable means known in the art to make it removable for washing. See FIG. 1. There may also be a padded strip (not illustrated) along the central vertical line of the lining 71 to prevent the canisters 50 from contact with the user's back.

Figure 5:
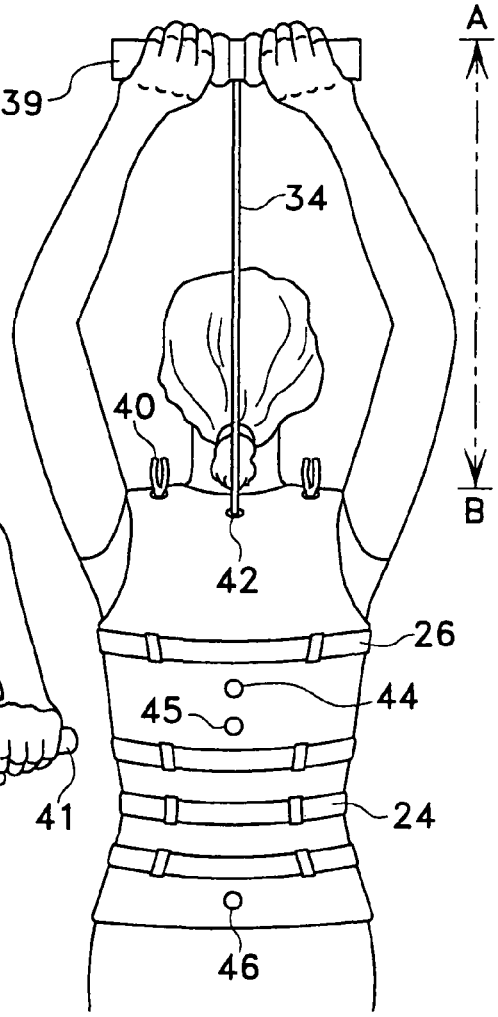
FIG. 5 is a rear view of the exercise vest in use by a person standing and using the rear band.

In operation, the vest 20 may be donned in the usual manner and the four straps 24 and 26 closed in the front and adjusted as to length so that the vest lies close to the body but is not binding. The user then selects the particular band or bands to be used. If the rear band 34 is selected, the user may reach behind his or her head, grasp the rear handlebar 39 with both hands and lift the handlebar 39 away from the support clips 40. The handlebar 39 may then be raised as far as possible then lowered according to the abilities of the user and the resistance of the rear band 34. The rear band 34 may be designed to be moved primarily in an up and down motion through distance A-B as seen in FIG. 5. If the resistance is not satisfactory, the vest may be removed and the resistance increased or decreased by appropriately rotating the spool 56 of the rear band canister 44 to alter the length of the elastic band. The positioning of the rear band canister 44 may be important to the stretchability and resistance of the rear band 34. If the rear band canister 44 is placed too high on the back panel 21 of the vest 20 the elastic rear band 34 may be too short to offer sufficient resistance variations and may leave little room for adjustment. The rear band canister 44 may be located below the uppermost strap 26 to provide a longer elastic band, smoother stretchability, and more resistance variations. When the user has completed the desired number of repetitions, the handlebar 39 may be returned to its position within the support clips 40 where it may remain out of the way and not interfere with further uses of the vest 20.

Figure 4:
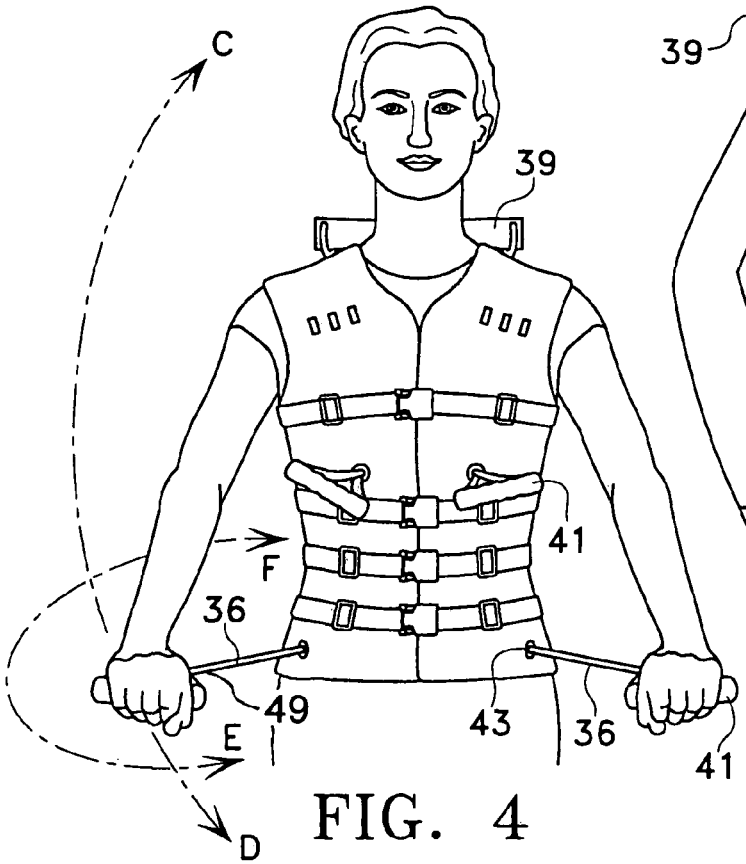
FIG. 4 is a front view of the exercise vest in use by a person standing and using the lower front bands.
Figure 6:
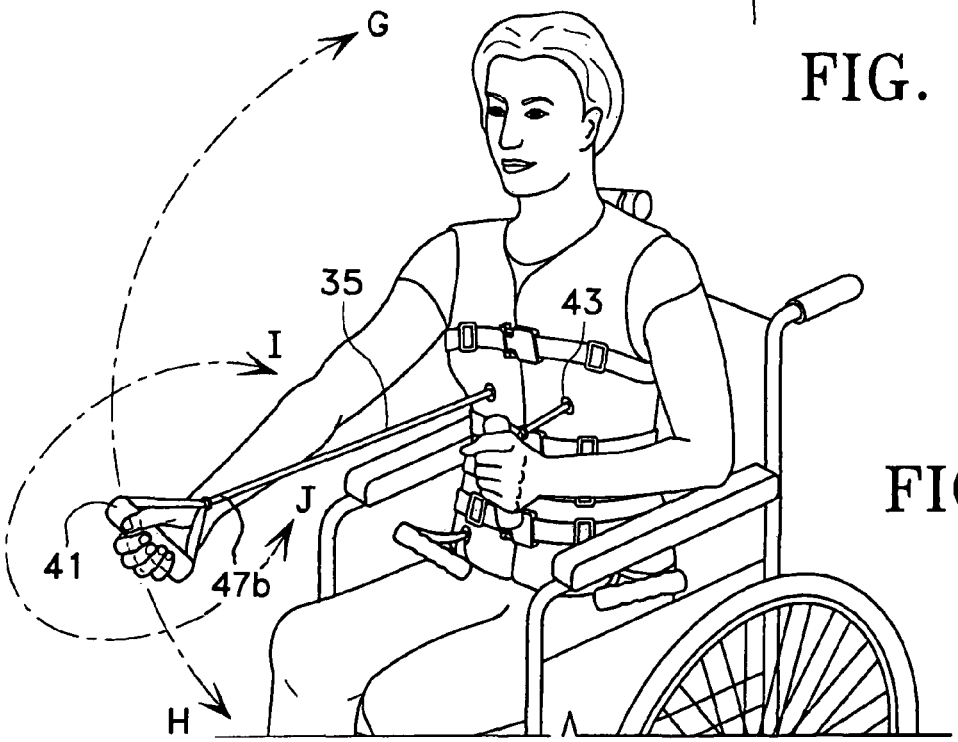
FIG. 6 is a front perspective view of the vest in use by a person seated in a wheelchair and using the upper front bands.

If the lower side bands 36 are selected, the user may grasp one or both of the hand grips 41 attached to the lower side bands 36 and pull forward and to the side, through arc E-F, or in any up and down direction over long arc C-D as noted in FIG. 4. The lower side bands 36 may be pulled in an in-and-out motion at any angel within the arcs or they may be moved up and down or forward and back through all or a portion of the arcs. Thus the user may perform any motion that he or she might have performed using a hand weight. The upper side bands 35 may be similarly utilized by grasping one or both of the attached hand grips 41. Again, the field of motion may cover a front to back arc I-J and a long up and down arc G-H. The upper side bands 35 may be also be pulled in an in and out, up and down or forward and back motion or at any angle through the arcs as seen in FIG. 6. The resistance on both the upper side bands 35 and the lower side bands 36 may be adjusted as needed by rotating the spools 56 in the appropriate canisters 45 and 46 as previously noted. As illustrated in FIGS. 4 through 6, the user of the vest 20 may be standing or seated.

Though the exercise vest 20 of the present invention may be used by any person, it may be particularly effective for persons who may have to be seated when exercising and for persons confined to wheelchairs. Often after an injury a person who must use a wheelchair does not have the upper body strength needed to propel the chair by rotating the side wheels. By using the exercise vest 20, the necessary upper body strength may be attained. Since the tension and the resistance of the bands may be easily adjustable, one vest 20 may provide all of the exercise equipment the injured person may need to acquire the necessary upper body strength to become self sufficient. The resistance may be increased slowly according to the needs of the user. The specific configuration (octagonal) of the head 59 of the spool 56 may permit small and therefore subtle changes in the resistance so that the user may build up strength according to his or her own time frame and abilities.

The vest 20 may be constructed of any strong fabric that may be capable of accommodating the canisters and guide tubes. A nylon fabric may be preferable since it is non-absorbent, long lasting and strong. The removable lining may be of cotton which is absorbent or of a non-absorbent microfiber. Either may provide a soft material for the comfort of the user. The vest 20 may be made in any desirable color or color combination so that it may be attractive and serve to encourage exercising. The adjustable straps 24 and 26 may make it possible for persons of varying size to use the same vest 20, but the vest 20 may also be made in any suitable range of sizes.

While one embodiment of the present invention has been illustrated and described in detail, it is to be understood that this invention is not limited thereto and may be otherwise practiced within the scope of the following claims.

I claim:

1. An exercise device comprising:

a vest having a back panel, and two front panels;

at least two horizontal straps that encircle the vest, are attached thereto, and are closable in the front of the vest;

means to close the straps in front of the vest;

a rear elastic band having a first end and a second end, the first end being affixed to the inside of the back panel and the second end passing though an opening in the back panel above the point of fixation of the first end and being affixed to a handle;

at least one upper side elastic band having a first end and a second end, the first end being affixed to the inside of the back panel below the point of fixation of the rear elastic band and the second end passing through an opening in one of the front panels and being affixed to a hand grip;

at least one lower side elastic band having a first end and a second end, the first end being affixed to the inside of the back panel below the point of fixation of the at least one upper side elastic band and the second end passing through an opening in one of the front panels situated below the opening for the at least one upper side elastic band and being affixed to a hand grip;

means to affix the rear elastic band to the inside of the back panel;

means to affix the at least one upper side elastic band to inside of the back panel; and means to affix the at least one lower side elastic band to the inside of the back panel;

whereby a user can select at least one of the elastic bands, grasp the handle or hand grip and perform exercises by stretching the at least one elastic band according to his or her abilities.

2. An exercise device comprising:

a vest having a back panel, a right front panel and a left front panel;

at least three horizontal straps that encircle the vest, are attached thereto, and are closable in the front of the vest;

means to close the straps in front of the vest a rear band having a first end and a second end, the first end being affixed to the inside of the back panel and the second end passing though an exit opening in the back panel above the point of fixation of the first end and being affixed to a handle;

two upper side bands each having a first end and a second end, the first ends being affixed to the inside of the back panel below the point of fixation of the rear band, the second end of one band passing through an exit opening in the right front panel, the second end of the other band passing through an exit opening in the left front panel and the second ends of both bands being affixed to hand grips;

two lower side bands each having a first end and a second end, the first ends being affixed to the inside of the back panel below the points of fixation of the upper side bands, the second end of one band passing through an exit opening in the right front panel, the second end of the other band passing through an exit opening in the left front panel, both exit openings being below the exit openings for the upper side bands and the second ends of both bands being affixed to hand grips;

means to impart stretchability to the bands;

means to affix the rear elastic band to the inside of the back panel;

means to affix the two upper side elastic band to inside of the back panel; and means to affix the two lower side elastic band to the inside of the back panel;

whereby a user can select at least one of the bands, grasp the handle or hand grip and perform exercises by stretching the band according to his or her abilities.

3. An exercise device comprising:

a vest having a back panel, a right front panel and a left front panel;

four horizontal straps that encircle the vest, are attached thereto, and are closable in the front of the vest;

means to close the straps in front of the vest a rear elastic band having a first end and a second end, the first end being affixed to the inside of the back panel and the second end passing though an exit opening in the back panel above the point of fixation of the first end and being affixed to a handle;

two upper side elastic bands each having a first end and a second end, the first ends being affixed to the inside of the back panel below the point of fixation of the rear elastic band, the second end of one elastic band passing through an exit opening in the right front panel, the second end of the other elastic band passing through an exit opening in the left front panel and the second ends of both elastic bands being affixed to hand grips;

two lower side elastic bands each having a first end and a second end, the first ends being affixed to the inside of the back panel below the points of fixation of the upper side elastic bands, the second end of one elastic band passing through an exit opening in the right front panel, the second end of the other elastic band passing through an exit opening in the left front panel, both exit openings being below the exit openings for the upper side elastic bands and the second ends of both elastic bands being affixed to hand grips;

means to affix the rear elastic band to the inside of the back panel;

means to affix the two upper side elastic band to inside of the back panel; and means to affix the two lower side elastic band to the inside of the back panel;

whereby a user can select at least one of the elastic bands, grasp the handle or hand grip and perform exercises by stretching the at least one elastic band according to his or her abilities.

4. The exercise device of claim 3 wherein the uppermost horizontal strap is situated above a substantial mid level of the vest and the other three horizontal straps are situated below the substantial mid level of the vest.

5. The exercise device of claim 4 wherein the point of fixation of the rear elastic band lies below the uppermost horizontal strap, the points of fixation of the upper side elastic bands lie below the point of fixation of the rear elastic band and above the other three horizontal straps and the points of fixation of the two lower elastic bands lie below the other three horizontal straps.

6. The exercise device of claim 3 wherein the means to close the straps in front of the vest is selected from the group consisting of clasps, buckles, snaps, hooks, ties and hook and loop fasteners.

7. The exercise device of claim 3 wherein the handle to which the rear elastic band is attached is a handlebar.

8. The exercise device of claim 7 further comprising holding means to hold and maintain the handlebar in a fixed position when not in use and is easily releasable when the handlebar is to be used.

9. The exercise device of claim 8 wherein the holding means comprises a pair of clips, one affixed approximate each shoulder on the outside of the vest.

10. The exercise device of claim 3 further comprising a lining covering the inside of the vest.

11. The exercise device of claim 10 wherein the lining is reversibly removable.

12. The exercise device of claim 3 further comprising multiple vent openings to provide air circulation.

13. The exercise device of claim 3 further comprising at least one pocket attached to the vest.

14. The exercise device of claim 3 further comprising guide means within the vest through which the elastic bands are guided from the points of fixation to the back panel to the exit openings.

15. The exercise device of claim 14 wherein the guide means comprises tubular enclosures affixed to the inner surfaces of the vest panels.

16. The exercise vest of claim 3 wherein the four horizontal straps are adjustable in length whereby the vest can be fitted to persons of varying sizes.

17. The exercise device of claim 3 wherein the means to affix the rear elastic band, the two upper side elastic bands and the two lower side elastic bands to the inside of the back panel comprise canisters affixed to the back panel.

18. The exercise device of claim 17 wherein each canister comprises:

a housing having a continuous side wall contiguous with a flat bottom, an opening centrally disposed in the bottom of the housing, and at least one aperture substantially at mid level in the side wall;

cover means for closing the housing, and a cutout centrally disposed through the cover means;

a rotatable spool centrally disposed within the housing, said spool having a central portion, a head, a base, and an axial bore within the substantially lower half of the central portion, and said spool being dimensioned such that the base is contiguous with the bottom of the housing and the head occupies the cutout in the cover means;

tension spring means affixed at a first end to the top of the axial bore and at a second end through the opening in the bottom of the housing for biasing the spool and enabling the spool to rotate;

means to affix the canisters to the back panel;

whereby the elastic bands are attached to the central portion of the spool and extend outwardly of the housing through the at least one aperture.

19. The exercise device of claim 18 further comprises hinged tab means disposed on the upper surface of the spool head, said tab means for facilitating the grasping of the spool head and raising the head upward until it is clear of the cover means whereby a user can rotate the spool to wind or unwind the attached elastic bands in order to alter the length and thereby the resistance of the elastic bands.

20. The exercise device of claim 19 further comprising stop means fixedly attached to each elastic band at a preset distance from the canister, said stop means for preventing more than the preset extent of the elastic bands from being wound onto the spool, said stop means being larger than the at least one aperture in the side wall of the housing.

21. The exercise device of claim 18 wherein the head of the spool has the shape of a flat sided geometric figure having at least three sides and the cutout in the cover means has the same shape whereby when the base of the spool is adjacent to the flat bottom of the housing and the head of the spool is disposed within the cutout the spool is prevented from rotating.

22. The exercise device of claim 18 wherein the tension spring means comprises a cylinder and hollow piston in which is disposed a tension spring.

23. The exercise device of claim 18 wherein the means to affix the canister to the back panel comprises a circular flange about the circumference of the cover means and coplanar therewith such that the flange is affixed directly and securely to the back panel of the vest and the cover of the canister is visible and accessible from the outside of the back panel and the housing of the canister is inside the back panel.

24. An exercise device comprising:

a vest assembly having a back panel, two front panels, and at least two horizontal straps that encircle the body and closable in the front of the vest assembly;

means for closing the straps in front of the vest assembly;

rear tension means for creating resistance when stretched, a first portion of which is affixed to the back panel and a second portion of which is affixed to a handlebar, said handlebar being adapted to be grasped in both hands and raised and lowered vertically over the head of the user;

at least two side tension means for creating resistance when stretched, a first portion of each side tension means being affixed to the vest assembly and a second portion of each side tension means being affixed to a hand grip, said hand grip being adapted to be extended from the side of the body forward, to the side, downward and upward; and means for affixing the rear tension means and means for affixing each of the at least two side tension means to the vest assembly, all of said means enabling the rear tension means and the at least two side tension means to be adjusted according to the abilities of the user;

whereby the user can select at least one of the tension means, grasp the handlebar or hand grip and perform exercises by stretching the at least one tension means according to his or her abilities.

25. An exercise device as described in claim 24 wherein the rear tension means and the at least two side tension means comprise canisters containing bands that provide the resistance when stretched.

26. An exercise device as described in claim 24 further comprising means for holding and maintaining the handlebar in a fixed position when not in use and being easily releasable when the handlebar is to be used.

27. An exercise device as described in claim 26 wherein the holding means comprises a pair of clips, one affixed approximate each shoulder on the outside of the back panel.

28. A method of exercising the upper body comprising the steps of:

obtaining an exercise vest which comprises a back panel, a right front panel and a left front panel, four horizontal straps that encircle the vest, are attached thereto, and are closable in the front of the vest, means to close the straps in front of the vest, a rear elastic band having a first end and a second end, the first end being affixed to the inside of the back panel and the second end passing though an exit opening in the back panel above the point of fixation of the first end and being affixed to a handlebar, reversible holding means to securely hold the handlebar when not in use, two upper side elastic bands each having a first end and a second end, the first ends being affixed to the inside of the back panel below the point of fixation of the rear elastic band, the second end of one elastic band passing through an exit opening in the right front panel, the second end of the other elastic band passing through an exit opening in the left front panel and the second ends of both elastic bands being affixed to hand grips, two lower side elastic bands each having a first end and a second end, the first ends being affixed to the inside of the back panel below the point of fixation of the upper side elastic bands, the second end of one elastic band passing through an exit opening in the right front panel, the second end of the other elastic band passing through an exit opening in the left front panel, both exit openings being below the exit openings for the upper side elastic bands and the second ends of both elastic bands being affixed to hand grips and means to affix each of the elastic bands to the back panel and to alter the resistance of the elastic bands;

donning the exercise vest;

securing the straps in the front of the exercise vest;

selecting the rear elastic band;

grasping the handlebar and releasing it from the reversible holding means;

holding the handlebar with both hands and raising the handlebar above the head and lowering the handlebar to shoulder level;

repeating the raising and lowering of the handlebar until a desired number of repetitions have been accomplished;

returning the handlebar to the reversible holding means;

selecting one of the pairs of side elastic bands;

grasping the hand grip on the end of each elastic band and stretching the elastic bands by pulling on the hand grips in any desired direction and permitting the elastic bands to contract;

repeating these movements until the desired number of repetitions have be accomplished;

selecting the remaining pair of side elastic bands;

grasping the hand grip on the end of each elastic band and stretching the elastic bands by pulling on the hand grips in any desired direction and permitting the elastic bands to contract;

deciding that there is not the desired resistance in the remaining pair of side elastic bands;

removing the vest and altering the resistance of the side elastic bands;

donning the exercise vest again;

securing the straps in the front of the exercise vest;

grasping the hand grip on the end of each of the adjusted elastic bands and stretching the elastic bands by pulling on the hand grips in any desired direction and permitting the elastic bands to contract;

repeating these movements until the desired number of repetitions have be accomplished; and removing the exercise vest;

whereby the upper body has been fully exercised.

29. The method of exercising the upper body of claim 28 wherein the means to affix the elastic bands to the back panel and to alter the resistance of the elastic bands is a canister which comprises:

a housing having a continuous side wall contiguous with a flat bottom, an opening centrally disposed in the bottom of the housing, and at least one aperture substantially at mid level in the sidewall; cover means for closing the housing, and a cutout having the shape of a flat sided geometric figure having at least three sides centrally disposed through the cover means; a spool centrally disposed within the housing, said spool having a central portion, a head in the same shape as the cutout, a base, and an axial bore within the central portion, and said spool being dimensioned such that the base is contiguous with the bottom of the housing and the head occupies the cutout in the cover means; tension spring means affixed at a first end within the axial bore and at a second end through the opening in the bottom of the housing for biasing the spool and enabling the spool to rotate; hinged tab means disposed on the upper surface of the spool head; and means to affix the canister to the back panel.

30. The method of exercising the upper body of claim 29 wherein the method of altering the resistance of the elastic bands comprises the steps of:

raising the hinged tab means until the head of the spool is above the cutout;

grasping the head and rotating it until the desired resistance of the bands has been attained; and releasing the head so that the spool is retracted by means of the tension spring means, the head is again disposed within the cutout, and the hinged tab means is lowered.

* * * * *